US010044139B2

(12) United States Patent
Jalbert

(10) Patent No.: US 10,044,139 B2
(45) Date of Patent: Aug. 7, 2018

(54) DISPLAY STRUCTURE WITH MODULAR ELECTRICAL CONNECTOR

(71) Applicant: UCP INTERNATIONAL CO. LTD, Kowloon (HK)

(72) Inventor: David Jalbert, Coventry, RI (US)

(73) Assignee: UCP INTERNATIONAL COMPANY LIMITED, Hong Kong (HK)

( * ) Notice: Subject to any disclaimer, the term of this patent is extended or adjusted under 35 U.S.C. 154(b) by 0 days.

(21) Appl. No.: 15/292,873

(22) Filed: Oct. 13, 2016

(65) Prior Publication Data

US 2017/0033500 A1 Feb. 2, 2017

Related U.S. Application Data

(63) Continuation of application No. PCT/US2015/025838, filed on Apr. 14, 2015.

(60) Provisional application No. 61/979,488, filed on Apr. 14, 2014.

(51) Int. Cl.

| | |
|---|---|
| ***F21S 6/00*** | (2006.01) |
| ***H01R 13/631*** | (2006.01) |
| ***H01R 13/15*** | (2006.01) |
| ***H01R 13/627*** | (2006.01) |
| ***H01R 24/86*** | (2011.01) |
| ***H01R 43/26*** | (2006.01) |
| *H01R 103/00* | (2006.01) |

(52) U.S. Cl.

CPC ..... *H01R 13/6315* (2013.01); *H01R 13/15* (2013.01); *H01R 13/6272* (2013.01); *H01R 24/86* (2013.01); *H01R 43/26* (2013.01); *H01R 2103/00* (2013.01)

(58) Field of Classification Search

CPC ..... A47G 33/06; A41G 1/005; F21S 4/001; F21W 2121/00

USPC ..... 362/122, 123; 428/8

See application file for complete search history.

(56) References Cited

U.S. PATENT DOCUMENTS

| | | | | |
|---|---|---|---|---|
| 4,437,782 | A | 3/1984 | Geisthoff | |
| 4,802,861 | A | 2/1989 | Gaston | |
| 4,888,966 | A | 12/1989 | Zapfel et al. | |
| 5,620,347 | A * | 4/1997 | Sawada | H01R 13/111 439/851 |
| 6,698,598 | B1 | 3/2004 | Appenteng | |
| 7,132,139 | B2 * | 11/2006 | Yang | A47G 33/06 428/17 |
| 7,252,536 | B2 | 8/2007 | Lazaro et al. | |
| 8,454,186 | B2 | 6/2013 | Chen | |
| 8,454,187 | B2 | 6/2013 | Chen | |
| 8,569,960 | B2 | 10/2013 | Chen | |

(Continued)

OTHER PUBLICATIONS

PCT/US2015/025838 International search report and written opinion dated Jul. 29, 2015.

*Primary Examiner* — Hien Vu

(74) *Attorney, Agent, or Firm* — Fisher Broyles LLP

(57) ABSTRACT

The disclosed display structures comprises an electrical connecter having a first modular subsystem and a second modular subsystem. The first and second modular subsystems may have complementary guides configured to rotationally fix the first and second modular subsystems to one of a predetermined number of relative rotational orientations where the first and second modular subsystems can create an electrical connection.

18 Claims, 10 Drawing Sheets

(56) References Cited

U.S. PATENT DOCUMENTS

| | | | | |
|---|---|---|---|---|
| 8,863,416 | B2 * | 10/2014 | Leung | A47G 33/06 40/442 |
| 8,876,321 | B2 | 11/2014 | Chen | |
| 8,936,379 | B1 | 1/2015 | Chen | |
| 8,959,810 | B1 | 2/2015 | Leung et al. | |
| 8,974,072 | B2 | 3/2015 | Chen | |
| 9,044,056 | B2 * | 6/2015 | Chen | A41G 1/005 |
| 9,179,793 | B2 * | 11/2015 | Chen | A47G 33/06 |
| 9,439,528 | B2 | 9/2016 | Chen | |
| 9,441,800 | B1 | 9/2016 | Chen | |
| 9,441,823 | B1 | 9/2016 | Chen | |
| 9,484,687 | B1 | 11/2016 | Chen | |
| 9,526,286 | B2 | 12/2016 | Chen | |
| 9,572,446 | B2 * | 2/2017 | Chen | A47G 33/06 |
| 9,593,831 | B2 * | 3/2017 | Yu | F21V 23/06 |
| 9,648,919 | B2 | 5/2017 | Chen | |
| 9,671,074 | B2 * | 6/2017 | Chen | F21S 4/10 |
| 9,677,748 | B1 | 6/2017 | Chen | |
| 9,677,749 | B2 | 6/2017 | Chen | |
| 9,843,147 | B2 | 12/2017 | Leung et al. | |
| 2003/0206412 | A1 | 11/2003 | Gordon et al. | |
| 2005/0082244 | A1 | 4/2005 | Ho et al. | |
| 2012/0076957 | A1 | 3/2012 | Chen et al. | |
| 2013/0301245 | A1 | 11/2013 | Chen | |

* cited by examiner

DISPLAY STRUCTURE WITH MODULAR ELECTRICAL CONNECTOR

TECHNICAL FIELD

This disclosure generally relates to display structure, and more particularly to display structures having a modular electrical connector.

BACKGROUND

Display structures have many applications, such artificial trees. Artificial trees may be configured to have branches that branch out and decorative lights disposed on the branches. The decorative lights may be powered by electricity delivered by wires that run through the length the of the display structure.

DETAILED DESCRIPTION

Example embodiments will now be described hereinafter with reference to the accompanying drawings, which form a part hereof, and which illustrate example embodiments which may be practiced. As used in the disclosures and the appended claims, the terms "embodiment", "example embodiment", and "exemplary embodiment" do not necessarily refer to a single embodiment, although they may, and various example embodiments may be readily combined and interchanged, without departing from the scope or spirit of example embodiments. Furthermore, the terminology as used herein is for the purpose of describing example embodiments only and is not intended to be limitations. In this respect, as used herein, the term "in" may include "in" and "on", and the terms "a," "an" and "the" may include singular and plural references. Furthermore, as used herein, the term "by" may also mean "from", depending on the context. Furthermore, as used herein, the term "if" may also mean "when" or "upon," depending on the context. Furthermore, as used herein, the words "and/or" may refer to and encompass any and all possible combinations of one or more of the associated listed items.

Figure 1:
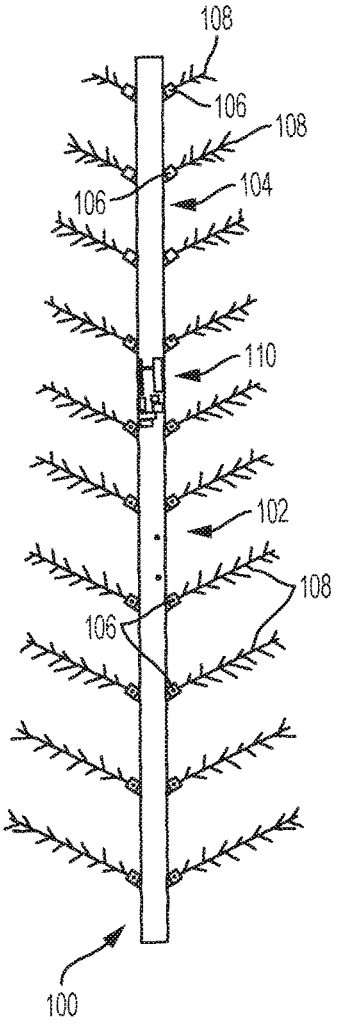
FIG. 1 is a schematic diagram showing an exemplary embodiment of a display structure, in accordance with the present disclosure.

FIG. 1 is a schematic diagram showing an exemplary embodiment of a display structure 100. The display structure 100 may include first and second modular portions 102 and 104 configured to removably connect to each other. In an embodiment, at least one of the first and second modular portions 102 and 104 includes a plurality of mounting structures 106 and branch structures 108 connected to the plurality of mounting structures 106. In another embodiment, both the first and second modular portions 102 and 104 include a plurality of mounting structures 106 and branch structures 108 as shown in FIG. 1.

It is to be appreciated that the mounting structures 106 may have a variety of configurations suitable for mounting branch structures 108. In an embodiment, the mounting structures 106 may include mounting brackets 106 integrally or removably connected to the body of the first and second modular portions 102 and 104. The mounting structures may be radially positioned in a variety of alignments to result in one of several predetermined branch patterns when the first and second modular portions 102 and 104 are connected to each other.

For aesthetic purposes, the display structure 100 may be decorated with light strings (not shown) disposed on the branch structures 108. The light strings may have wires that extend into the first and second modular portions 102 and 104. For ease of assembly, a modular electrical connecter 110 may be disposed in the display structure 100 to allow electrical connection from the first and second modular portions 102 and 104 so that wires of light strings for the second modular portion 104 do not need to extend through the length of the display structure 100.

Figure 2:
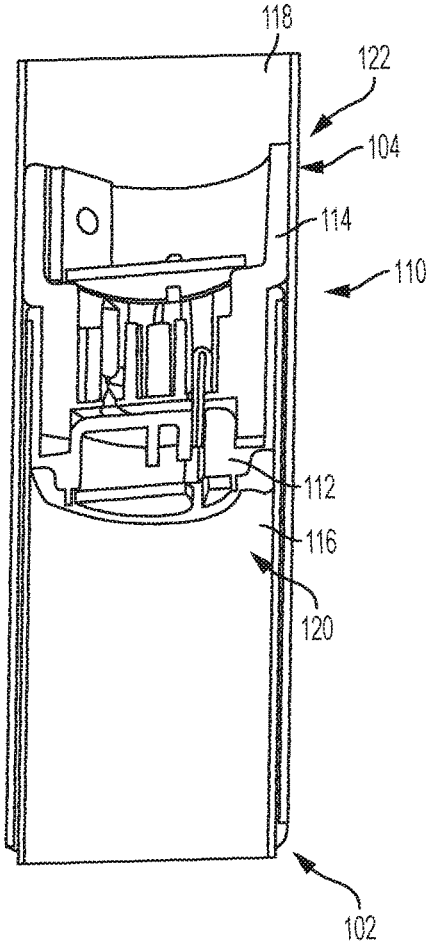
FIG. 2 is a schematic diagram showing a partial, cross-sectional view of the display structure of FIG. 1, in accordance with the present disclosure.

FIG. 2 is a schematic diagram showing a partial, cross-sectional view of the display structure 100 of FIG. 1. As illustrated in the exemplary embodiment in FIG. 2, the modular electrical connector 110 may include a first modular subsystem 112 at least partially seated in a cavity 116 defined in an end portion 120 of the first modular portion 102. The modular electrical connector 110 may also include a second modular subsystem 114 at least partially seated in a cavity 118 defined in an end portion 122 of the second modular portion 104.

Figure 3A:
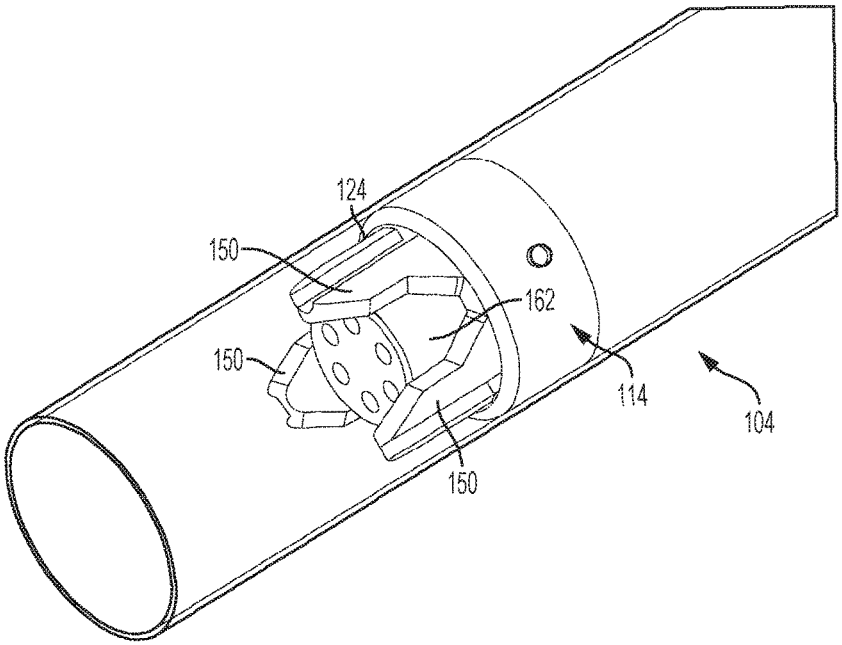
FIGS. 3A and 3B is a schematic diagram illustrating the display structure of FIG. 1 in a disconnected orientation, in accordance with the present disclosure.
Figure 3B:
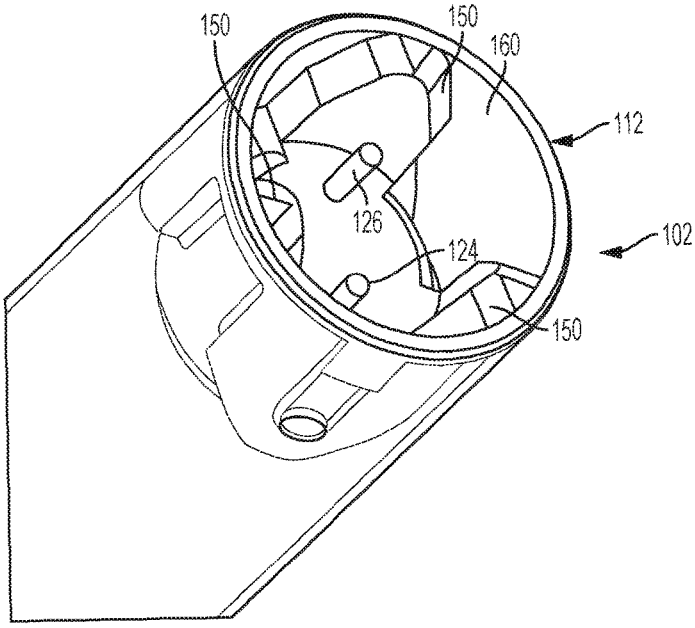

FIGS. 3A and 3B is a schematic diagram illustrating the display structure 100 of FIG. 1 in a disconnected orientation. Referring to FIGS. 3A and 3B, the first modular subsystem 112 of the electrical connector 110 may include first and second pins 124 and 126 operable to be received the second modular subsystem 114 of the electrical connector 110.

Figure 4:
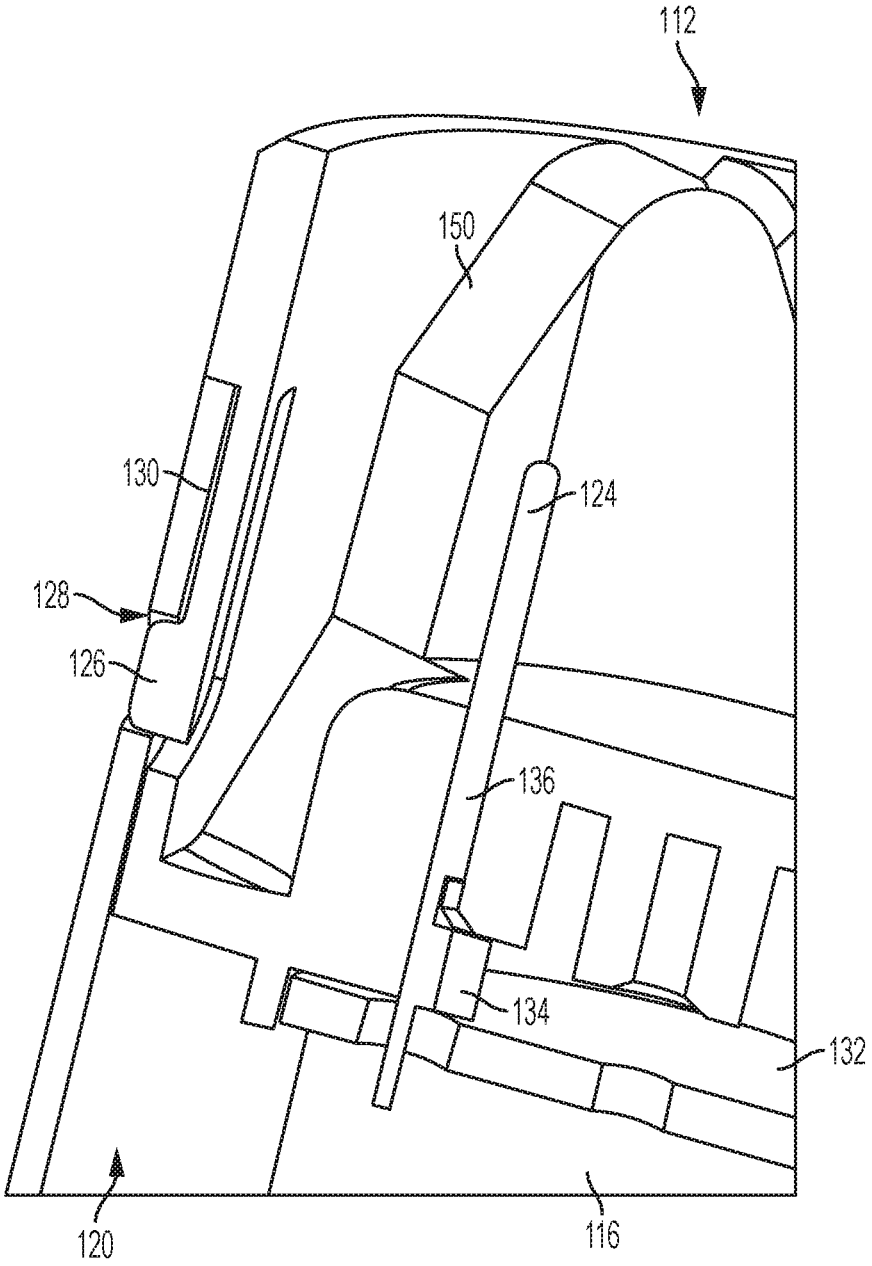
FIG. 4 is a schematic diagram illustrating a partial, focused view of a first modular subsystem of an electrical connector shown in FIGS. 2 and 3A-3B, in accordance with the present disclosure.
Figure 5A:
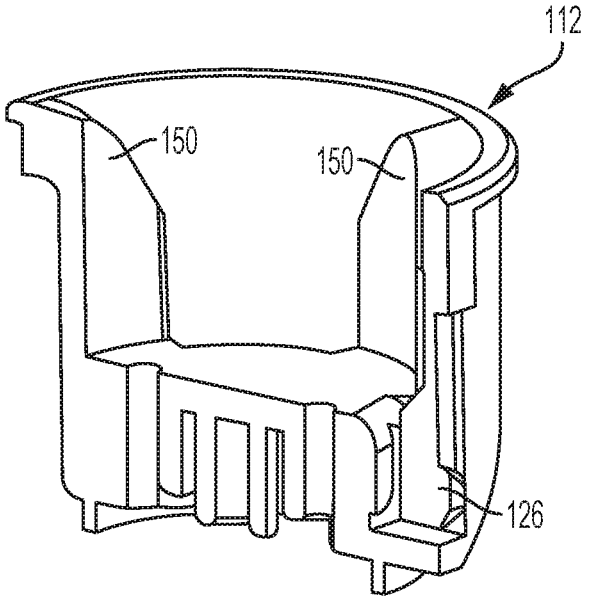
FIGS. 5A and 5B are schematic diagrams illustrating partial cross-sectional and partial elevational views, respectively, of the first modular subsystem of the electrical connector shown in FIGS. 2 and 3A-3B, in accordance with the present disclosure.
Figure 5B:
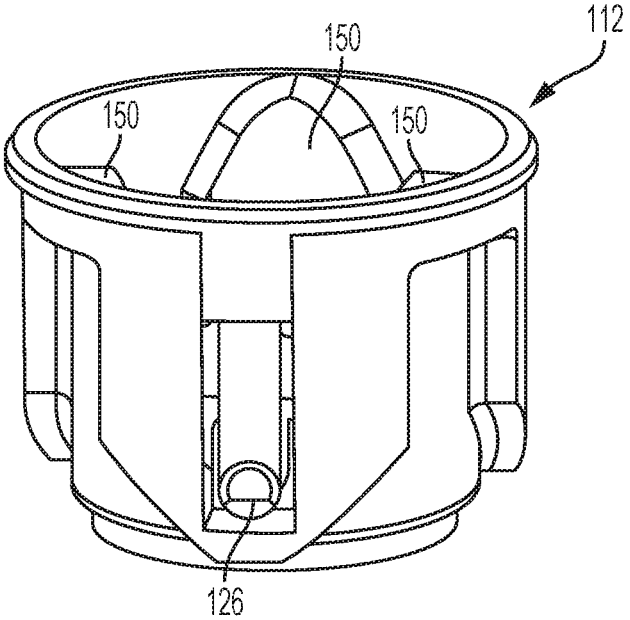

FIG. 4 is a schematic diagram illustrating a partial, focused view of the first modular subsystem 112 of an electrical connector 110. FIGS. 5A and 5B are schematic diagrams illustrating partial cross-sectional and partial elevational views, respectively, of the first modular subsystem 112 of the electrical connector 110. Referring to FIGS. 4, 5A, and 5B, in an embodiment, the first modular subsystem 112 may include an optional depressible latch 126 configured to releasably engage a recess area 128 defined in an interior surface 130 of the end portion 120 of the first modular portion 102. As such, first modular subsystem 112 may be at least partially releasably seated in the cavity 116 of the end portion 120. It is to be appreciated that the depressible latch 126 may be configured in any way suitable to releasably connect the first modular subsystem 112 to the first modular portion 102. In an exemplary embodiment, the depressible latch 126 may provide a snap fit mechanism for easy assembly.

The pins 124 and 126 of the first modular subsystem 112 may be seated in a cavity 132 of the first modular subsystem 112. In an embodiment, the pin 124 and pin 126 (not shown) may include a protrusion extending 134 laterally into a radial cavity 132, thereby preventing the pins 124 and 126 from falling out of a longitudinal aperture 136.

Figure 6A:
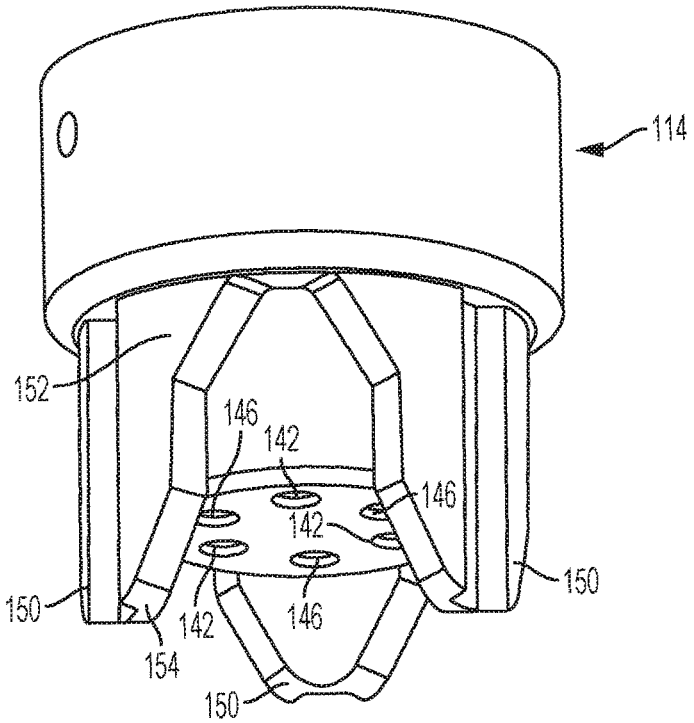
FIGS. 6A and 6B are schematic diagrams illustrating elevational and partial cross-sectional views, respectively, of a second modular subsystem of the electrical connector shown in FIGS. 2 and 3A-3B, in accordance with the present disclosure.
Figure 6B:
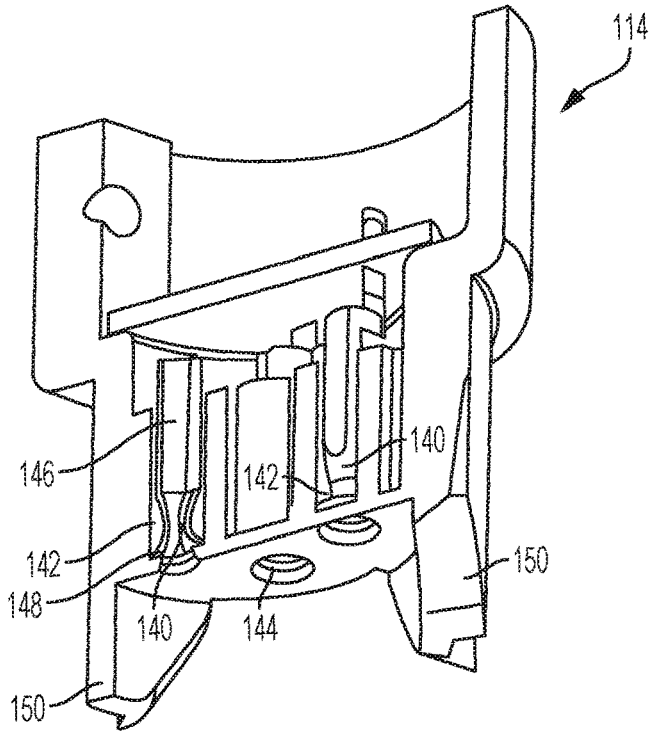

FIGS. 6A and 6B are schematic diagrams illustrating elevational and partial cross-sectional views, respectively, of the second modular subsystem 114 of the electrical connector 110. In an embodiment, the second modular subsystem 114 may include a body 124 and a first set of conductive contacts 140 disposed in the body 124, in which the first set of conductive contacts 140 may include at least one contact 140. In one embodiment, the first set of conductive contacts 140 may include 2 to 4 contacts 140. In an embodiment, the first set of conductive contacts 140 may preferably include 3 contacts 140 for reasons to be discussed below. The second modular subsystem 114 may also include a first set of off-center apertures 142 defined through the body 124. The first set of off-center apertures 142 may include at least one off-center aperture 142 providing access to the first set of conductive contacts 140. The number of off-center aperture 142 may correspond to the number of conductive contacts 140.

In an embodiment, the second modular subsystem 114 may further include a second set of conductive contacts 144 disposed in the body 124. The second set of conductive contacts 144 may include at least one contact 144 electrically isolated from the first set of conductive contacts 140. In one embodiment, the second set of conductive contacts 144 may include 2 to 4 contacts 144. In an embodiment, the first set of conductive contacts 144 may preferably include 3 contacts 144 for reasons to be discussed below. The number of the first and second sets of the conductive contacts 140 and 144 may the same.

The second modular subsystem 114 may also include a second set of off-center apertures 146 defined through the body 124. The second set of off-center apertures 146 may include at least one off-center aperture 146 providing access to the second set of conductive contacts 144. The number of off-center aperture 144 may correspond to the number of conductive contacts 144.

Figure 7A:
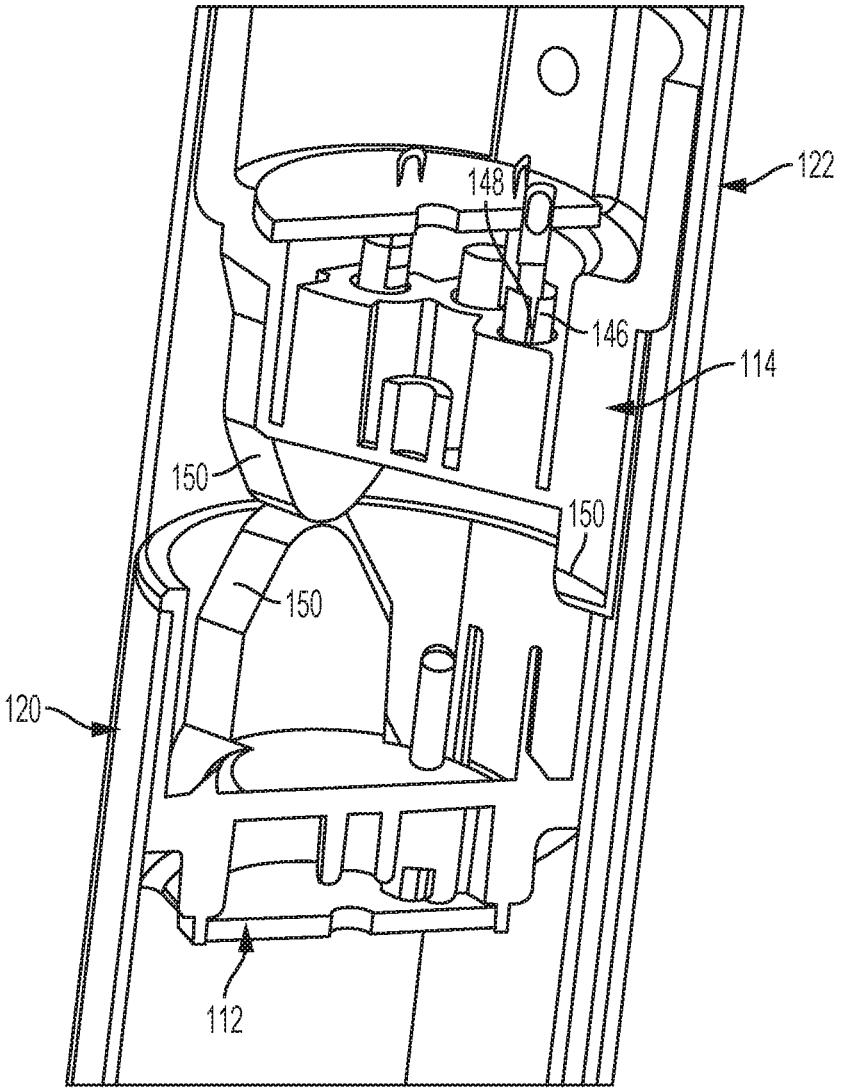
FIGS. 7A and 7B are schematic diagrams illustrating partial cross-sectional views of the electrical connector of FIGS. 1-6B being guided by exemplary guides, in accordance with the present disclosure.
Figure 7B:
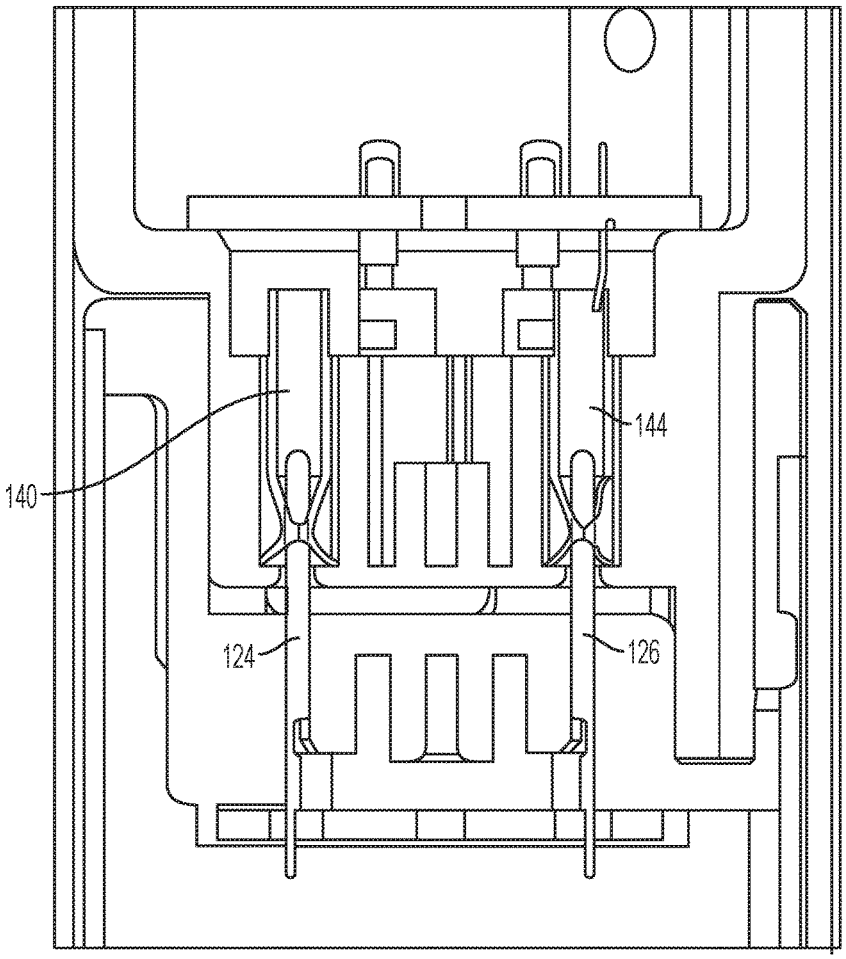
Figure 8A:
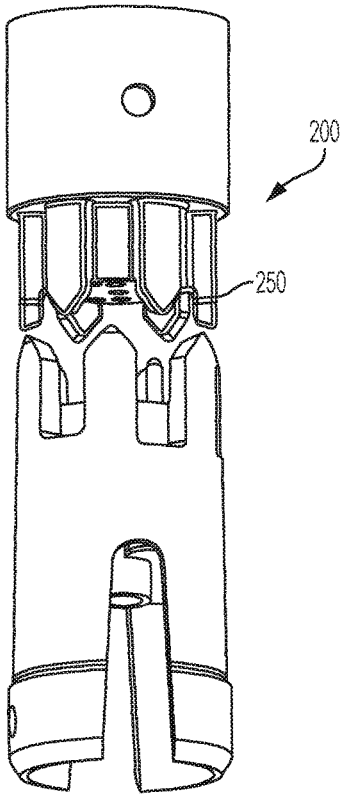
FIGS. 8A-8D are schematic diagrams illustrating elevational, partial cross-sectional, exploded, and partial cross-sectional exploded views, respectively, of another exemplary embodiment of a modular electrical connector that may be used in the display structure of FIG. 1, in accordance with the present disclosure.
Figure 8B:
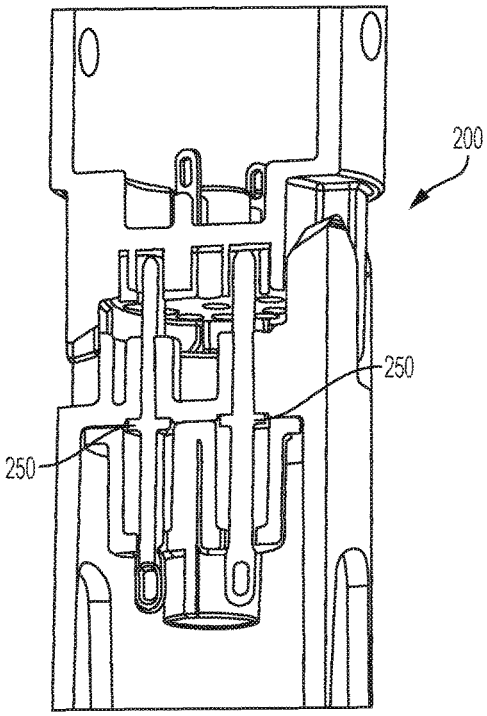
Figure 8C:
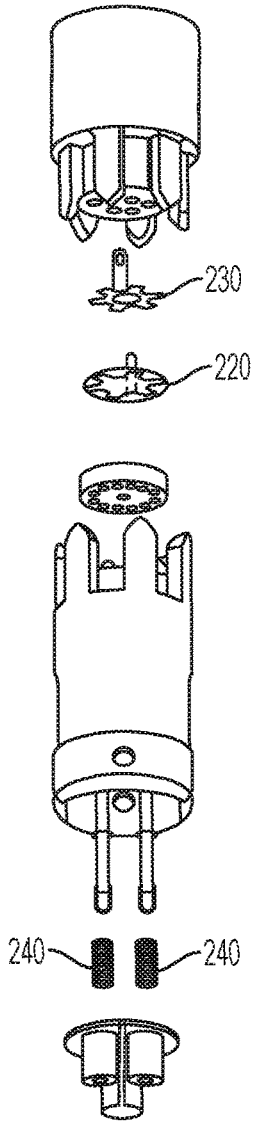
Figure 8D:
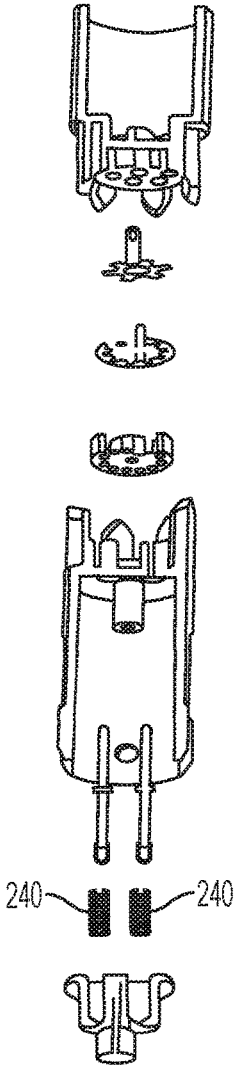

Referring to FIGS. 2 to 6B, the first and second modular subsystems 112 and 114 may include complementary guides 150. FIGS. 7A and 7B are schematic diagrams illustrating partial cross-sectional views of the electrical connector 110 being guided by complementary guides 150 for connections. To assemble the first and second modular portions 102 and 104, the end portions 120 and 122 of the first and second modular portions 102 and 104 may be aligned longitudinally and the complementary guides 150 may rotationally guide the first and second modular subsystems 112 and 114 in the end portions 120 and 122 to connected with each other at least one predetermined relative rotational orientation. In an embodiment, the complementary guides 150 of the first and second modular subsystems 112 and 114 are configured to rotationally fix the first and second modular subsystems 112 and 114 to one of a plurality predetermined number of relative rotational orientations.

In an embodiment, the complementary guides 150 of the first and second modular subsystems 112 and 114 may include teeth 150 having proximal and distal ends 152 and 154 with the proximal end 152 of each teeth 150 having a width greater than the width of distal end 154 of each teeth 150. This configuration of the teeth 150 allows for a wide margin of error as the modular subsystems 112 and 114 are being aligned rotationally yet still allows for guidance towards the fixed predetermined rotational orientation as the modular subsystems 112 and 114 are being pushed towards each other. In an embodiment, to further aid the guidance of the modular subsystems 112 and 114 the distal end 154 of each teeth 150 may have a rounded edge. In an embodiment in which the teeth 150 may extend both longitudinally and radially, the term width may be understood to be the arc width of the teeth.

It is to be appreciated that the number of teeth 150 may be determined by the number of contacts in the first and second sets of conductive contacts 140 and 144. For example, in an embodiment in which there are three conductive contacts 140 and 144 in each of the first and second sets of conductive contacts 140 and 144, then there are three possible relative rotational orientation for connecting the modular subsystems 112 and 114. As such, the modular subsystems 112 and 114 may include three radially spaced teeth 150 defined on a radial surface 160 of the first modular subsystem 112 and three radially spaced teeth 150 defined on a radial surface 162 of the second modular subsystem 114. The radial surfaces 160 and 162 may be either interior or exterior surfaces although the former may be preferred in some embodiments for ease of assembly.

It is to be appreciate that the number of teeth 150 may be any number depending on the number of contacts 140 and 144. In another example, the complementary guides 150 may include six radially spaced teeth 150 defined on a radial surface 160 of the first modular subsystem 112 and six radially spaced portions 150 defined on a radial surface 162 of the second modular subsystem 114.

The connection of the first and second modular subsystems 112 and 114 allows for the first pin 124 of the first modular subsystem 112 in the first modular portion 102 to be: a) received in one of the first set of off-center apertures 142 of the second modular subsystem 114 in the second modular portion 104 and b) connected to one of the first set of conductive contacts 140. The connection of the first and second modular subsystems 112 and 114 also allows the second pin 126 of the first modular subsystem 112 in the first modular portion 102 to be: a) received in one of the second set of off-center apertures 146 of the second modular subsystem 114 in the second modular portion 104 and b) connected to one of the second set of conductive contact 144.

To maintain good electrical connection, the at least one contact 140, 144 of the first and second set of conductive contacts 140, 144 may include an elongated body portion 146 and a neck portion 148, the elongated body portion having a width greater than a width of the neck portion. Additionally, the elongated body portion 146 may include a longitudinal gap 148, thereby imparting axial flexibility to the contacts 140, 144. In an embodiment, the width of the neck portion 148 may be substantially the same as or less than a width of the first or second pin 126 and 128 to ensure tight connection when the pins 126 and 128 are disposed through the neck portion 148.

Figure 9:
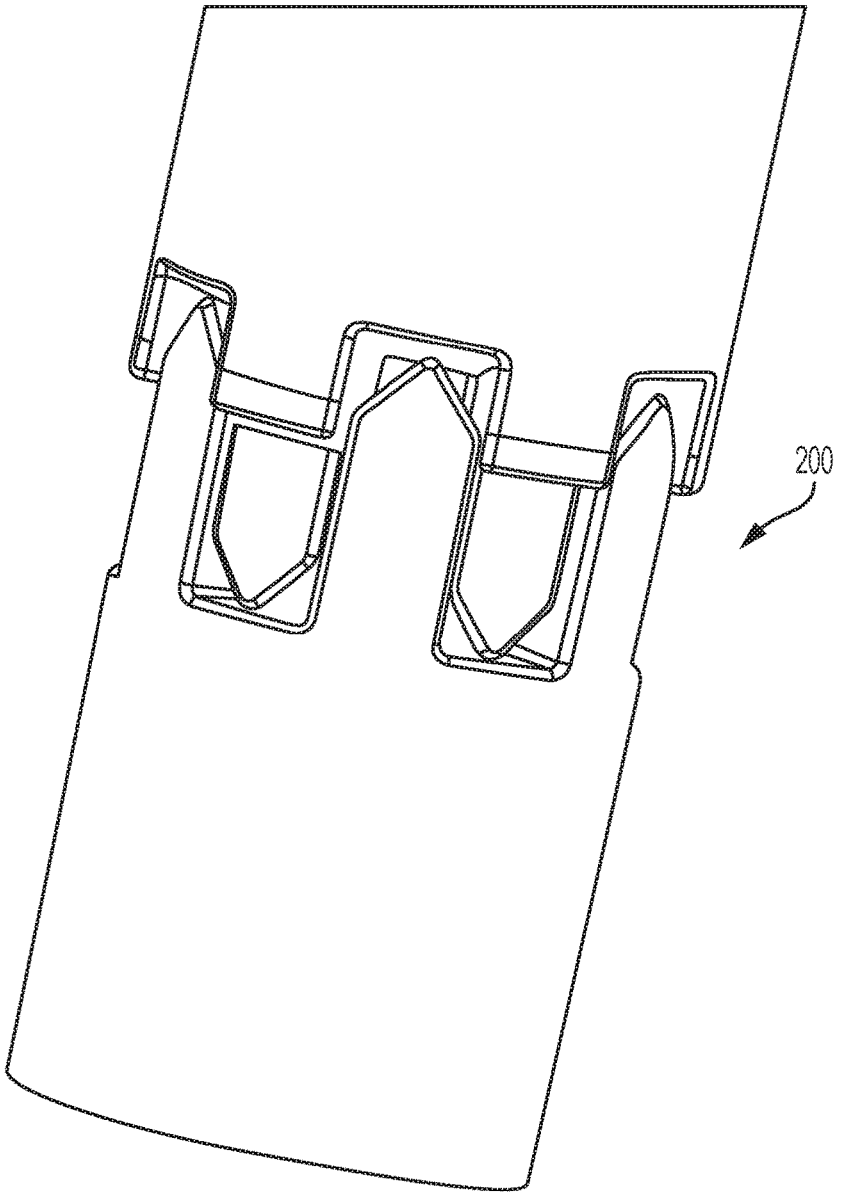
FIG. 9 is a schematic diagram illustrating an elevational view of the modular electrical connector of FIGS. 8A-8D in a rotationally fixed, connected orientation.

It is to be appreciated that the modular electrical connectors that may be rotationally aligned using complementary guides may have different configurations for the electrical contacts. FIGS. 8A-8D are schematic diagrams illustrating elevational, partial cross-sectional, exploded, and partial cross-sectional exploded views, respectively, of another exemplary embodiment of a modular electrical connector 200 that may be used in the display structure 100 of FIG. 1. FIG. 9 is a schematic diagram illustrating an elevational view of the modular electrical connector 200 of FIGS. 8A-8D in a rotationally fixed, connected orientation.

The electrical connector 200 may include guides 250 for rotationally aligning the first and second modular subsystems of electrical connector 200 in the same manner as discussed above for electrical connector 110. The electrical connector 200 may differ from the electrical connector 110 in that instead of individual contacts 140 and 144, the second modular subsystem of the electrical connector 200 may include a first conductive contact 220 disposed in the body, a first plurality of longitudinal off-center apertures defined through the body and exposing a plurality of contact areas on the first conductive contact 220, a second conductive contact 230 disposed in the body, the second conductive contact being electrically isolated from the first conductive contact 220, and a second plurality of longitudinal off-center apertures defined through the body and exposing a plurality of contact areas on the second conductive contact 230. The guides 250 are operable to rotationally fix the first and second modular subsystems of the connector 200 to one of a predetermined number of relative rotational orientations, whereby 1) the first pin of the first modular subsystem in the first modular portion is received in one of the first plurality of longitudinal off-center apertures of the second modular subsystem in the second modular portion and connected to one of the plurality of contact areas on the first conductive contact 220; and 2) the second pin of the first modular subsystem in the first modular portion is received in one of the second plurality of longitudinal off-center apertures of the second modular subsystem in the second modular portion and connected to one of the plurality of contact areas on the second conductive contact 230. In an embodiment, first modular subsystem of the electrical connector 200 further comprises springs 240 positioned adjacent to bases 250 of the first and second pins, the springs 240 being configured to exert a force on the first and second pins against the respective contact areas when the first and second modular subsystems are connected. The number of the contact areas on the first and second contact 220 and 230 may vary just as the number of contacts 140 and 144 may vary.

While various embodiments in accordance with the disclosed principles have been described above, it should be understood that they have been presented by way of example only, and are not limiting. Thus, the breadth and scope of the example embodiments described herein should not be limited by any of the above-described exemplary embodiments, but should be defined only in accordance with the claims and their equivalents issuing from this disclosure. Furthermore, the above advantages and features are provided in described embodiments, but shall not limit the application of such issued claims to processes and structures accomplishing any or all of the above advantages.

Words of comparison, measurement, and timing such as "at the time," "equivalent," "during," "complete," and the like should be understood to mean "substantially at the time," "substantially equivalent," "substantially during," "substantially complete," etc., where "substantially" means that such comparisons, measurements, and timings are practicable to accomplish the implicitly or expressly stated desired result. Words relating to relative position of elements such as "about," "near," "proximate to," and "adjacent to" shall mean sufficiently close to have a material effect upon the respective system element interactions.

Additionally, the section headings herein are provided for consistency with the suggestions under 37 C.F.R. 1.77 or otherwise to provide organizational cues. These headings shall not limit or characterize the invention(s) set out in any claims that may issue from this disclosure. Specifically and by way of example, although the headings refer to a "Technical Field," such claims should not be limited by the language chosen under this heading to describe the so-called technical field. Further, a description of a technology in the "Background" is not to be construed as an admission that technology is prior art to any invention(s) in this disclosure. Neither is the "Summary" to be considered as a characterization of the invention(s) set forth in issued claims. Furthermore, any reference in this disclosure to "invention" in the singular should not be used to argue that there is only a single point of novelty in this disclosure. Multiple inventions may be set forth according to the limitations of the multiple claims issuing from this disclosure, and such claims accordingly define the invention(s), and their equivalents, that are protected thereby. In all instances, the scope of such claims shall be considered on their own merits in light of this disclosure, but should not be constrained by the headings herein.

What is claimed is:

1. A display structure comprising:

first and second modular portions configured to removably connect to each other, wherein at least one of the first and second modular portions comprises a plurality of mounting structures and branch structures connected to the plurality of mounting structures; and an electrical connector comprising:

a first modular subsystem at least partially seated in a cavity defined in an end portion of the first modular portion;

a second modular subsystem at least partially seated in a cavity defined in an end portion of the second modular portion;

wherein, the first modular subsystem of the electrical connector comprises first and second pins;

wherein the second modular subsystem of the electrical connector comprises:

a body;

a first set of conductive contacts disposed in the body, the first set of conductive contacts comprising at least one contact;

a first set of off-center apertures defined through the body, the first set of off-center apertures comprising at least one off-center aperture providing access to the first set of conductive contacts;

a second set of conductive contacts disposed in the body, the second set of conductive contacts comprising at least one contact electrically isolated from the first set of conductive contacts; and a second set of off-center apertures defined through the body, the second set of off-center apertures comprising at least one off-center aperture providing access to the second set of conductive contacts;

wherein the first and second modular subsystems comprise complementary guides, and when the first and second modular subsystems are connected with each other, the complementary guides of the first and second modular subsystems are configured to rotationally fix the first and second modular subsystems to one of a predetermined number of relative rotational orientations, whereby:

1) the first pin of the first modular subsystem in the first modular portion is: a) received in one of the first set of off-center apertures of the second modular subsystem in the second modular portion; and b) connected to one of the first set of conductive contacts; and 2) the second pin of the first modular subsystem in the first modular portion is: a) received in one of the second set of off-center apertures of the second modular subsystem in the second modular portion; and b) connected to one of the second set of conductive contact; and wherein a first modular subsystem comprises a depressible latch extended from an interior wall of the first modular subsystem to releasably engage a recess area defined in an interior surface of the end portion of the first modular portion thereby at least partially seating the first modular subsystem in the cavity of the end portion.

2. The display structure of claim 1, wherein the depressible latch comprises a snap fit mechanism.

3. The display structure of claim 1, wherein the complementary guides of the first and second modular subsystems comprise teeth having proximal and distal ends, the proximal end of each teeth having width greater than the distal end of each teeth.

4. The display structure of claim 3, wherein the distal end of each teeth has a rounded edge.

5. The display structure of claim 1, wherein the at least one contact of the first set of conductive contacts comprises an elongated body portion and a neck portion, the elongated body portion having a width greater than a width of the neck portion.

6. The display structure of claim 5, wherein the elongated body portion comprises a longitudinal gap, thereby imparting axial flexibility to the at least one contact of the first set of conductive contacts.

7. The display structure of claim 5, wherein the width of the neck portion is substantially the same as or less than a width of the first pin.

8. The display structure of claim 1, wherein the complementary guides comprises three radially spaced portions defined on a radial surface of the first modular subsystem and three radially spaced portions defined on a radial surface of the second modular subsystem.

9. The display structure of claim 8, wherein the radial surface of the first modular subsystem comprises an interior surface of the first modular subsystem.

10. The display structure of claim 1, wherein the complementary guides comprises six radially spaced portions defined on a radial surface of the first modular subsystem and six radially spaced portions defined on a radial surface of the second modular subsystem.

11. A display structure comprising:

first and second modular portions configured to removably connect to each other, wherein at least one of the first and second modular portions comprises a plurality of mounting structures and branch structures connected to the plurality of mounting structures; and an electrical connector comprising:

a first modular subsystem at least partially seated in a cavity defined in an end portion of the first modular portion;

a second modular subsystem at least partially seated in a cavity defined in an end portion of the second modular portion;

wherein, the first modular subsystem of the electrical connector comprises first and second pins;

wherein the second modular subsystem of the electrical connector comprises:

a body;

a first conductive contact disposed in the body;

a first plurality of longitudinal off-center apertures defined through the body and exposing a plurality of contact areas on the first conductive contact;

a second conductive contact disposed in the body, the second conductive contact being electrically isolated from the first conductive contact; and a second plurality of longitudinal off-center apertures defined through the body and exposing a plurality of contact areas on the second conductive contact;

wherein the end portions of the first and second modular subsystems comprise complementary guides, and when the first and second modular subsystems are connected with each other, the complementary guides of the first and second modular subsystems are configured to rotationally fix the first and second modular subsystems to one of a predetermined number of relative rotational orientations, whereby:

1) the first pin of the first modular subsystem in the first modular portion is received in one of the first plurality of longitudinal off-center apertures of the second modular subsystem in the second modular portion and connected to one of the plurality of contact areas on the first conductive contact; and 2) the second pin of the first modular subsystem in the first modular portion is received in one of the second plurality of longitudinal off-center apertures of the second modular subsystem in the second modular portion and connected to one of the plurality of contact areas on the second conductive contact; and wherein a first modular subsystem comprises a depressible latch extended from an interior wall of the first modular subsystem to releasably engage a recess area defined in an interior surface of the end portion of the first modular portion thereby seating the first modular subsystem in the cavity of the end portion.

12. The display structure of claim 11, wherein the first modular subsystem further comprises springs positioned adjacent to bases of the first and second pins, the springs being configured to exert a force on the first and second pins against the respective contact areas when the first and second modular subsystems are connected.

13. The display structure of claim 11, wherein at least three contact areas on the first conductive contact are exposed by the first plurality of longitudinal off-center apertures, and at least three contact areas are exposed by the second plurality of longitudinal off-center apertures.

14. The display structure of claim 11, wherein at least six contact areas on the first conductive contact are exposed by the first plurality of longitudinal off-center apertures, and at least six contact areas are exposed by the second plurality of longitudinal off-center apertures.

15. The display structure of claim 11, wherein the depressible latch comprises a snap fit mechanism.

16. The display structure of claim 11, wherein the complementary guides of the first and second modular subsystems comprise teeth having proximal and distal ends, the proximal end of each teeth having width greater than the distal end of each teeth.

17. The display structure of claim 16, wherein the distal end of each teeth has a rounded edge.

18. A method of assembling a display structure, comprising:

providing a display structure comprising:

first and second modular portions configured to removably connect to each other, wherein the first and second modular portions each comprise a plurality of mounting structures and branch structures connected to the plurality of mounting structures of the first and second modular portions;

an electrical connector comprising:

a first modular subsystem at least partially seated in a cavity defined in an end portion of the first modular portion;

a second modular subsystem at least partially seated in a cavity defined in an end portion of the second modular portion;

wherein, the first modular subsystem of the electrical connector comprises first and second pins;

wherein the second modular subsystem of the electrical connector comprises:

a body;

a first set of conductive contacts disposed in the body, the first set of conductive contacts comprising at least one contact;

a first set of off-center apertures defined through the body, the first set of off-center apertures comprising at least one off-center aperture providing access to the first set of conductive contacts;

a second set of conductive contacts disposed in the body, the second set of conductive contacts comprising at least one contact electrically isolated from the first set of conductive contacts; and a second set of off-center apertures defined through the body, the second set of off-center apertures comprising at least one off-center aperture providing access to the second set of conductive contacts;

wherein the end portions of the first and second modular subsystems comprise complementary guides longitudinally aligning the end portions of the first and second portions;

rotationally guiding the end portions of the first and second portions with the complementary guides of the first and second modular subsystems so that the complementary guides rotationally fix the first and second modular subsystems to one of a predetermined number of relative rotational orientations, whereby:

1) the first pin of the first modular subsystem in the first modular portion is: a) received in one of the first set of off-center apertures of the second modular subsystem in the second modular portion; and b) connected to one of the first set of conductive contacts; and 2) the second pin of the first modular subsystem in the first modular portion is: a) received in one of the second set of off-center apertures of the second modular subsystem in the second modular portion; and b) connected to one of the second set of conductive contact; and wherein a first modular subsystem comprises a depressible latch extended from an interior wall of the first modular subsystem to releasably engage a recess area defined in an interior surface of the end portion of the first modular portion thereby seating the first modular subsystem in the cavity of the end portion.

* * * * *